United States Patent [19]

Vidal et al.

[11] Patent Number: 4,826,639

[45] Date of Patent: May 2, 1989

[54] MOULDING PROCESS AND APPARATUS FOR MAKING ARCH-SHAPED CONCRETE STRUCTURES

[75] Inventors: Henri Vidal, 8 bis, Blvd., Maillot, 92200 Neuilly-sur-Seine, France; Santiago Muelas-Medrano, Madrid, Spain

[73] Assignee: Henri Vidal, Neuilly-sur-Seine, France

[21] Appl. No.: 5,212

[22] Filed: Jan. 20, 1987

[30] Foreign Application Priority Data

Jan. 21, 1986 [GB] United Kingdom ..... 8601413

[51] Int. Cl.[4] ..... B28B 1/30; B28B 7/04; B28B 7/06

[52] U.S. Cl. ..... 264/32; 249/11; 249/13; 249/24; 249/26; 249/47; 264/333; 405/146; 405/150

[58] Field of Search ..... 249/11, 24, 13, 26, 249/47; 264/32, 333; 405/150, 151, 146

[56] References Cited

U.S. PATENT DOCUMENTS

| | | | |
|---|---|---|---|
| 862,418 | 8/1907 | Street | 249/11 |
| 1,252,093 | 1/1918 | Davidson | 249/11 |
| 1,450,577 | 4/1923 | Brynoldt | 264/32 |
| 1,498,651 | 6/1924 | Folwell | 249/11 |
| 2,705,826 | 4/1955 | DeWaller | 264/32 |
| 3,618,886 | 11/1971 | Graham | 249/13 |
| 3,696,177 | 10/1972 | Holland | 249/11 |
| 4,155,967 | 5/1979 | South et al. | 264/32 |
| 4,170,093 | 10/1979 | Capelli et al. | 264/32 |

FOREIGN PATENT DOCUMENTS

| | | |
|---|---|---|
| 3125587 | 1/1983 | Fed. Rep. of Germany . |
| 3313347 | 10/1983 | Fed. Rep. of Germany . |
| 1212314 | 3/1960 | France . |
| 478120 | 1/1938 | United Kingdom . |
| 668378 | 3/1952 | United Kingdom . |
| 668371 | 3/1952 | United Kingdom . |
| 668372 | 3/1952 | United Kingdom . |
| 847515 | 9/1960 | United Kingdom . |

*Primary Examiner*—Willard Hoag

*Attorney, Agent, or Firm*—Burns, Doane, Swecker & Mathis

[57] ABSTRACT

An apparatus for moulding prefabricated curved concrete sections for use in the construction of arched or vaulted structures comprises a curved, upwardly convex mould made up of a series of reusable substantially flat mould plates pivotally supported by vertical pillars of adjustable height. The mould plates are hingedly connected to each other such that the angle of each plate to the adjacent plate is adjustable. The spacing between the vertical pillars is also adjustable, so that the mould plates provide a polygonal mould surface adjustable for moulding prefabricated concrete sections of different curvatures.

11 Claims, 4 Drawing Sheets

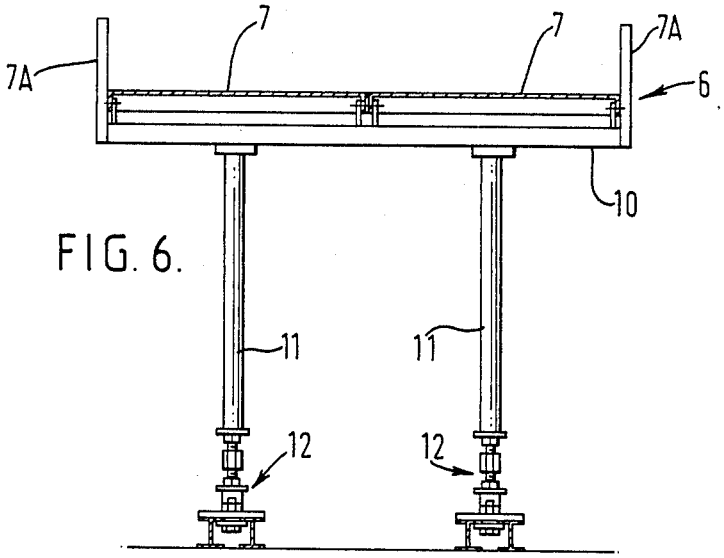
FIG. 6.
FIG. 7.
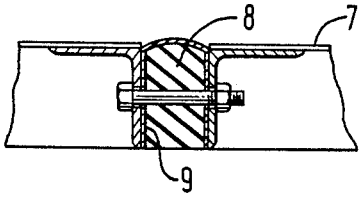
FIG. 8.
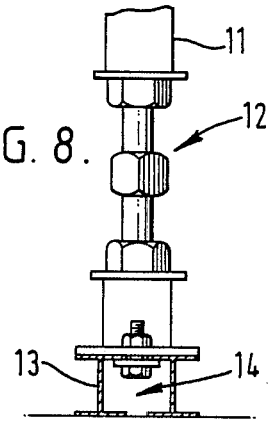
FIG. 9.
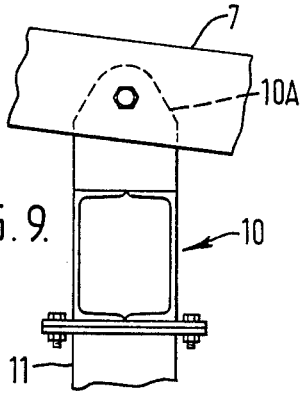

MOULDING PROCESS AND APPARATUS FOR MAKING ARCH-SHAPED CONCRETE STRUCTURES

FIELD OF THE INVENTION

The present invention relates to the production of curved prefabricated concrete members, in particular prefabricated sections for use in the construction of arched or vaulted structures such as tunnels or culverts.

BACKGROUND OF THE INVENTION

There is increasing interest in constructing hollow structures such as culverts and tunnels from prefabricated sections which can often increase the speed of construction and lower costs. Sections made from corrugated steel have been used for this purpose, but more recently there has been great interest in the use of sectional concrete structures, as for example in U.S. Pat. No. 3482 406 and European Pat. No. 81402.

In the design of arched or vaulted constructions incorporating prefabricated concrete sections, the shape and thickness of the sections must be such that under the design load, which will normally be a static load, the section is under compression at all times. In general, the optimal shape of the curve will be the so-called antifunicular of loads or an approximation thereto. The overall dimensions of the section depend largely on the requirements of the total structure and it can be seen that there is a virtually infinite range of sizes, thicknesses and cross-sections which are required to optimize the design of the wide range of structures which may be needed to suit different circumstances.

This situation has made the prefabrication of the sections relatively expensive. Where large structures are concerned, several circumferentially arranged sections will be required to complete the structure in order to permit these to be transported without undue difficulty. However, it is scarcely possible to design a structure of a particular size and shape to be used for all purposes since, for example, the load, e.g. depth of overfill above any particular tunnel or culvert, will depend entirely on the circumstances of the job and this will determine the optimal dimensions of the structure.

One solution to this problem is to use excessively thick prefabricated sections which will sustain a wide range of loads; it will readily be appreciated that this inevitably increases the cost not only of materials but also of handling and installation. Another possibility would be to design the sections to the optimal thickness and shape and to use a very large number of moulds each specially created for the structure concerned. Again this would be an expensive procedure. We have now found, however, that such prefabricated concrete sections can be made economically using moulds of variable curvature such that each mould is capable of forming a wide range of concrete sections of calculated optimal curvature and size.

British Patent specification No. 668372 describes an apparatus for the construction on site of an arched concrete roof wherein shuttering plates onto which the concrete of the arch is applied are supported by a beam of fixed curved appropriate to the design of the arch, the beam being supported by pillars of variable height. The shuttering plates overlap at their edges but are otherwise not attached to each other, so that after the concrete arch has set, the shuttering plates may be removed individually from below the arch. There is no suggestion of using such a system to construct prefabricated sections of a concrete arch and because of the use of a supporting beam of fixed curvature, the system could not be used to construct prefabricated sections of variable curvature suitable for prefabrication of a wide range of arch designs.

OBJECTS AND SUMMARY OF THE DISCLOSURE

Viewed from one aspect the invention provides a method of prefabricating curved concrete sections for use in the construction of arched or vaulted structures, comprising applying unhardened concrete to a curved, upwardly convex mould surface provided by a series of reusable mould members supported from below by vertical pillars of adjustable height, the unhardened concrete being applied to form a curved section of predetermined thickness and allowed to set, and separating the concrete section and the mould members, wherein the mould members are hingedly connected to each other such that the angle of each mould member to the adjacent mould member(s) is adjustable, and the spacing between the pillars supporting adjacent mould members being adjustable, whereby the mould members provide a mould surface adjustable for moulding prefabricated sections of different curvatures.

Viewed from another aspect, the invention provides an apparatus for moulding prefabricated curved concrete sections for use in the construction of arched or vaulted structures, comprising a curved, upwardly convex mould surface provided by a series of reusable mould members supported from below by vertical pillars of adjustable height, wherein the mould members are hingedly connected to each other such that the angle of each mould member to the adjacent mould member(s) is adjustable, and the spacing between the pillars supporting adjacent mould members being adjustable, whereby the mould members provide a mould surface adjustable for moulding prefabricated sections of different curvatures.

In this way, a convex mould can be created which forms an arch onto which the concrete can be poured to form concrete sections of the desired curvature. A close approximation to a calculated curve for any given concrete section can be achieved by using mould members which are substantially flat, although the members could be slightly curved e.g. with a curvature corresponding to the minimum the mould surface is expected to have in practice. It will be appreciated that the term 'curvature' is used in this context to include polygonal forms which approximate to a curve within the limits imposed by the finite dimensions of the sides of the polygon.

The mould members will most conveniently be of the same dimensions, in order to maximize the versatility of the mould. Further pillars and mould members may be added or removed to increase or decrease the overall length of the mould surface. However, the dimension of the mould members in the direction of curvature may be reduced in the region of greatest curvature so that the polygonal surface approximates more closely to a curve.

The lateral dimension of the mould members, of course, determines the width of the concrete sections produced. It will be appreciated that the choice of the width of the concrete section does not, in general, depend on the design calculations and can therefore conveniently be the same in all structures, thereby assisting in minimizing costs. Alternatively, longitudinal spacers may be installed down the center portion of the mould, so as to create narrower concrete sections.

The vertical pillars may be slidably supported on a rail to provide the adjustable spacing between the pillars. In such an arrangement, the pillars will generally be lockable to the rail at the appropriate positions. Each mould member may be hingedly supported by a single vertical pillar, but preferably each mould member is supported by a pair of vertical pillars spaced laterally to the direction of curvature of the mould surface such that the mould member is pivotable about a horizontal axis extending between the pillars.

It is generally not necessary to provide a surface in contact with the convex side of the concrete section except, in certain instances, near the end of the mould where the curvature is greatest so that that part of the mould assumes a significant angle to the horizontal.

The curved surface can be provided with side members the height of which is equal to the thickness of concrete required by calculation for the structure concerned, so that using conventional concrete casting techniques, the fresh concrete can be levelled off to the top of the side-members using a simple tamping beam. Although, in general, it is preferred to mould concrete sections of uniform thickness, using side-members of uniform height on the mould, it is possible for the sections to be of graduated thickness, for example being greater at points of maximum stress, by using side-members of an appropriate profile. Any longitudinal spacer down the center of the mould will generally have a height corresponding to the side members.

The hardened concrete sections will generally be lifted away from the mould surface, although it may also be possible to lower the mould surface to effect separation. The concrete sections will normally be reinforced with conventional reinforcing bars. These may, for example, be in grid form, with short spacing lugs at intervals to position the reinforcement correctly within the concrete. Such grids can readily be bent to conform to the required curvature.

One particularly useful design for a culvert consists of a simple arch comprising two symmetrically opposed curved concrete sections meeting at the apex of the arch and each resting on footings, e.g. light walls, or a base plate. The optimal dimensions and curvature for the two sections of the arch, which will, of course, be mirror images of each other, can readily be calculated for each structure.

BRIEF DESCRIPTION OF THE DRAWING

Additional objects and advantages of the invention will become apparent as the following detailed description of the invention is read in conjunction with the accompanying figures which illustrate the invention and are in no way limitative.

FIG. 6 is a detailed view of the section at VI—VI of FIG. 5.

FIG. 7 illustrates on a larger scale the detail A in FIG. 5.

FIG. 8 illustrates on a larger scale the detail indicated by D in FIG. 5.

FIG. 9 illustrates on a larger scale the detail B in FIG. 5.

DETAILED DESCRIPTION OF A PREFERRED EMBODIMENT

Figure 1:
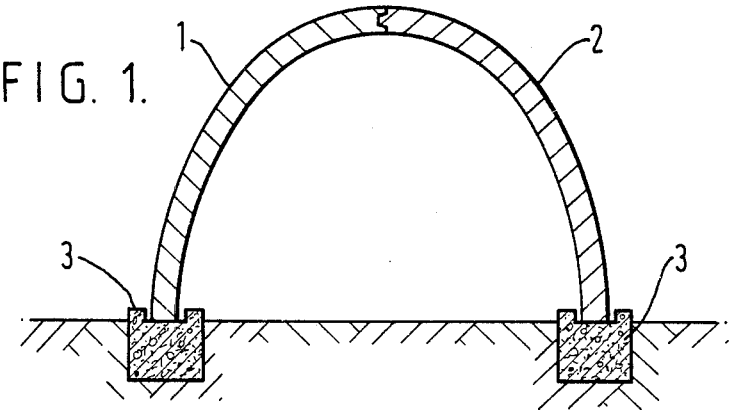
FIG. 1 is a cross-sectional view of a vaulted concrete structure, in which the arched side walls are formed by two complementary pieces, each of which rests on a footing.

Referring to the numbering indicated in the above figures, and initially to FIG. 1, the side walls comprise two separate and complementary sections, 1 and 2 (also termed "ribs") of theoretically ideal section. Each of the ribs 1 and 2 rests on a footing 3.

Figure 2:
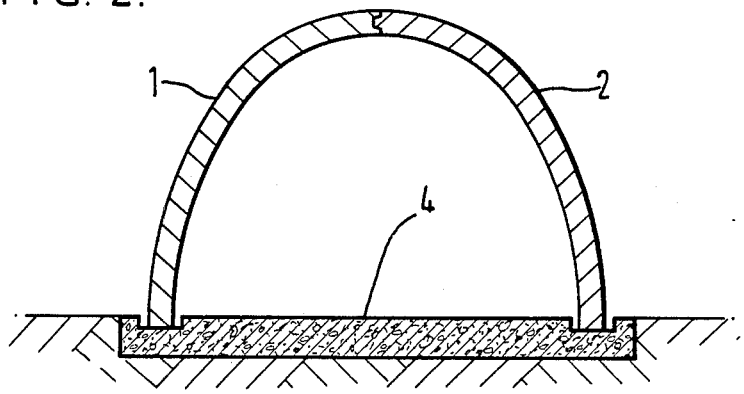
FIG. 2 is a section similar to the one shown in FIG. 1 in which the side walls rest on a slab foundation.

In FIG. 2, both complementary ribs 1 and 2 rest on a foundation slab.

Figure 3:
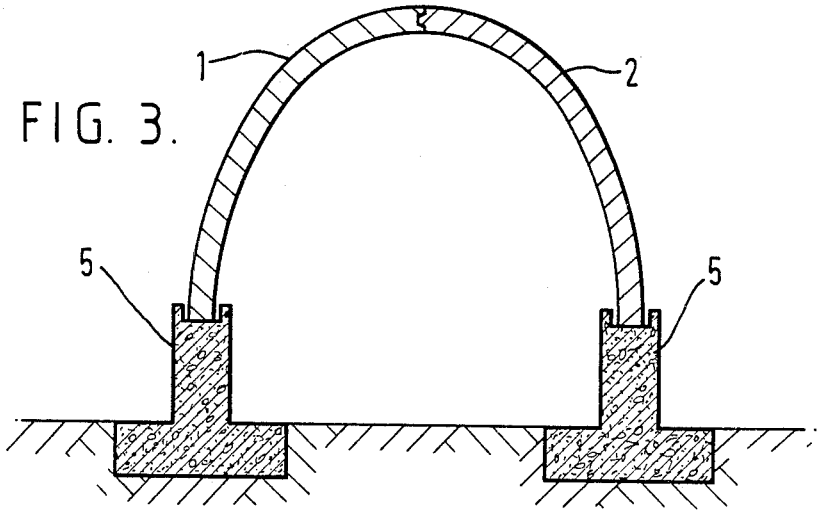
FIG. 3 is a sectional view simliar to the one shown in FIG. 1 in which the footings are extended vertically to produce light walls on which the side walls will rest, thus increasing the height of the same.

In FIG. 3 the ribs 1 and 2 rest on light walls 5.

Figure 4B:
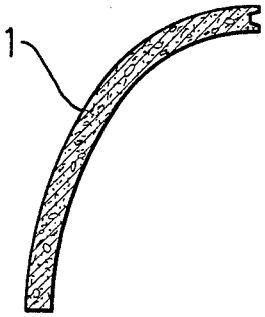
FIGS. 4*a*, 4*b* and 4*c* are respective plan, side and elevational side views of one of the complementary arched concrete sections pieces of the side walls, corresponding to the preceding figures.
Figure 4C:
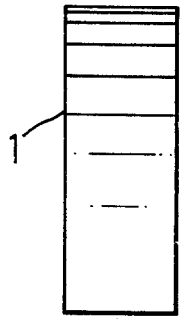
Figure 4A:
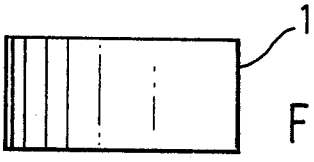

FIGS. 4*a*, 4*b* and 4*c* illustrate a typical "rib" 1 corresponding to a large section structure, in its three view: plan, side and elevational side views, respectively.

Figure 5:
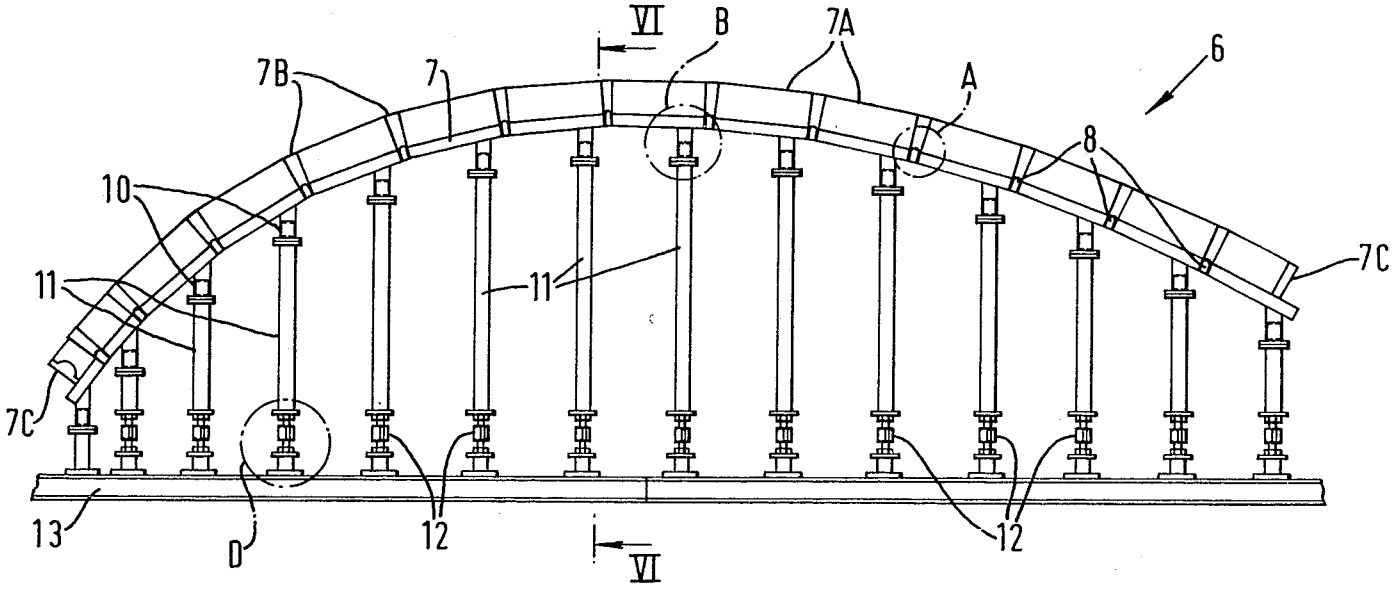
FIG. 5 is a general and elevational view of a mould for use in accordance with the method of the invention.

FIG. 5 shows a mould 6, for the manufacture of ribs of the type 1 or 2 in the above FIGS. 1–4. As shown in FIGS. 5 to 9, the mould 6 includes steel sheet reinforced plates 7, hingedly joined by flexible rubber joints 8. The plates joined in this manner constitute the part of the mould 6 on which the concrete will be poured and which is hereinafter called the "bed". The dimension of the steel sheets in the direction of the curvature, will depend on the form of the polygonal curve that is to be formed; in the areas of heavy curvature, the maximum dimension in this direction is desirably reduced. A dimension of the order of 50 cm. in the non-critical areas, and a dimension of the order of 25 cm. in the areas of marked curvature, is usually sufficient for the polygonal to be acceptable as an approximation to the ideal curve.

The rubber joints 8 are enclosed by a flexible steel cover 9, so that repeated stripping and cleaning of the bed of the mould 6 does not damage the rubber. This is shown more clearly in FIG. 7.

The plates 7 are provided with detachable rectangular side members 7A, secured, for example by bolts (not shown). The dimension of each of the side members 7A in the direction of curvature will be the same as that of the plate 7 to which it is attached; the vertical dimension will be selected according to the desired thickness of the concrete section to be produced. It will be appreciated that since adjacent plates 7 are at a slight angle to each other, and are separated by the rubber joints 8, there will be angular gaps between the side members 7A. These can be filled by spacers 7B which are secured by slidably engaging with the side-members 7A. It will be appreciated that while a range of side-members is required to produce concrete sections of different thicknesses and while an even greater range of angular spacers 7B is required to conform to the possible angles, these are readily made from sheet metal and contribute relatively little to the overall cost of the mould.

Where it is desired to produce a bevelled edge to the concrete sections, a suitably shaped insert can be provided at the base of each side member 7A, where it contacts the plate 7.

The plates 7 and side-members 7A attached thereto at the two ends of the mould are secured to end plates 7C by bolting (not shown). If desired, the end plates 7C can be profiled to produce shaped ends to the concrete sections for appropriate engagement with each other at the apex, as shown in FIG. 1.

In FIG. 9, the steel plates 7 forming the bed are secured to hinge means 10A rigidly attached to steel beams 10, which provide the necessary rigidity. Each of these beams 10 rests on two vertical leg members 11, (only one is shown), provided with adjustable extension means 12, which permit modification of the height of the legs members 11, as illustrated in FIGS. 6 and 8. It will be appreciated that the leg members 11 can be provided in a range of lengths, so that the extension means 12 simply serve to adjust the overall length more precisely to the requirements of the structure.

With this arrangement, by modifying the height of the vertical leg members 11, virtually any desired curvature of the mould, and hence of the concrete ribs 1 and 2, can be obtained. The width of the bed is partly dictated by the fabrication process and by the weight of the resulting sections. A reasonable width would be 2 to 2.5 m, but a separator (not shown) may be placed longitudinally down the center of the mould, so that two ribs of half the width are produced. The leg members 11 are movably connected at the bottom of the adjustable means 12 to two parallel rails 13 (only one is shown) to which they may be rigidly secured; the rails 13 absorb the vertical forces and by rigidly securing the bases of the extension means 12 to the rails 13, horizontal movement of the legs is also prevented. One form of anchor-system for the legs is illustrated in FIG. 8. In FIG. 8 it will be seen that each of the rails 13 consists of two H-section beams arranged to leave a central slot 14. Bolts 14A can then pass through the base of the extension means 12 and the slot 14 and on tightening nuts 14B on said bolts 14A, the leg can be rigidly secured in position.

In this manner, when it is desired to modify the curvature of the mould 6, the nuts 14B must first be loosened in order to permit possible horizontal movement of the legs, while the height of the same may be modified, by use of the adjustable extension means 12. It must be borne in mind that modification of the heights of the legs normally requires some horizontal movement of the bases.

It will be seen from the above description and drawings that a very wide range of possible shapes and dimensions of the mould are available and that the system can readily be adapted to automation.

While the invention has been illustrated and described in accordance with a preferred embodiment, it is recognized that variations and changes may be made and equivalents employed herein without departing from the invention as set forth in the claims.

What is claimed is:

1. A method of prefabricating curved concrete sections for use in the construction of arched or vaulted structures, comprising the steps of:

providing a curved, upwardly convex mould having a plurality of reusable mould members arranged along the length of the curve and supported from below by a plurality of vertical pillars, each vertical pillar being of independently adjustable height and arranged such that the spacing between adjacent pillars is adjustable, each vertical pillar being connected to one of said mould members by a hinged connection such that the angle between each pillar and the respective mould member is adjustable, the mould members being interconnected by a plurality of hinged connections each disposed between adjacent mould members such that the angle of each mould member to the adjacent mould member is adjustable, whereby the mould members provide a mould surface the curvature of which is variable for moulding prefabricated sections of different curvatures;

adjusting the mould to a desired curvature by adjusting the height and spacing between the adjacent said pillars;

applying unhardened concrete to the curved, upwardly convex mould surface, the unhardened concrete being applied to form a curved section of predetermined thickness;

allowing the concrete to set; and separating the concrete section from the mould members.

2. A method as claimed in claim 1, wherein the mould members are provided with side members arranged parallel to the length of the curve and on each side of the mould members and the method further comprising levelling off the unhardened concrete to the top of the side members.

3. A method as in claim 1, including disposing reinforcing bars in the unhardened concrete.

4. A method as claimed in claim 1, including sliding the pillars on a rail to adjust the spacing between the pillars.

5. A method as claimed in claim 1, wherein each mould member is supported by a pair of vertical pillars spaced laterally with respect to the length of the curve of the mould surface and pivoting the mould member about a horizontal axis extending between the pillars to achieve a desired mould curvature.

6. A method of prefabricating curved concrete sections for use in the construction of arched or vaulted structures, using a curved, upwardly convex mould surface provided by a plurality of reusable mould members arranged along the length of the curve and supported from below by a plurality of vertical pillars, each vertical pillar being of independently adjustable height and being arranged such that the spacing between adjacent pillars is adjustable, each vertical pillar being connected to a respective mould member by a hinged connection such that the angle between each said pillar and the respective mould member is adjustable, and the mould members being interconnected by a plurality of hinged connections along said curve said disposed between adjacent mould members such that the angle of each mould member to the adjacent mould member is adjustable, the method comprising:

adjusting the height of the vertical pillars and the spacing therebetween so as to bring about adjustment of the angles between the pillars and the mould members and of the angles between adjacent mould members, to obtain a desired curvature of the mould surface;

applying unhardened concrete to the mould surface to form a curved section of said desired curvature and of predetermined thickness;

allowing the concrete to set; and separating the concrete section and the mould members.

7. An apparatus for moulding prefabricated, curved, concrete sections for use in the construction of arched or vaulted structures, comprising:

a curved, upwardly convex mould surface provided by a plurality of reusable mould members;

a plurality of vertical pillars for supporting from below the reusable mould members, each vertical pillar being of independently adjustable height and being arranged such that the spacing between adjacent pillars is adjustable;

a hinged connection means for hingedly connecting each vertical pillar to a respective mould member such that the angle between each said pillar and the respective mould member is adjustable; and a plurality of hinged connection means each disposed between adjacent mould members for interconnecting the mould members such that the angle of each mould member to the adjacent mould is adjustable;

whereby the mould members provide a mould surface, the curvature of which is varaible for moulding prefabricated sections of different curvatures, such curvature variation being effected by adjustment of the height of the vertical pillars and the spacing between adjacent pillars, thereby adjusting the angles between the pillars and the mould members and the angles between adjacent mould members.

8. Apparatus as claimed in claim 7, wherein the mould members having side walls arranged parallel to the length of the curve and on each side of the mould members, so that unhardened concrete applied to the mould surface can be levelled off to the top of the side walls.

9. Apparatus as claimed in claim 7, wherein the vertical pillars are slidably supported on a rail to provide the adjustable spacing between pillars.

10. Apparatus as claimed in claim 7, wherein each mould member is supported by a pair of vertical pillars spaced laterally with respect to the length of the curve of the mould surface such that the mould member is pivotable about a horizontal axis extending between the pillars.

11. An apparatus as in claim 7, wherein the mould members have a decreased dimension in a region of greatest curvature from dimensions elsewhere in the apparatus so that the mould surface approximates more closely to a desired curve.

* * * * *